US005571563A

United States Patent [19]

Helms et al.

[11] Patent Number: 5,571,563

[45] Date of Patent: Nov. 5, 1996

[54] APPARATUS AND METHOD FOR PREVENTING INK RESOFTENING ON A PRINTED WEB AS THE WEB TRAVELS OVER A CHILL ROLL

[75] Inventors: Randall D. Helms, New Franken; Daniel J. Hansen, Green Bay, both of Wis.

[73] Assignee: Advance Systems, Inc., Green Bay, Wis.

[21] Appl. No.: 406,572

[22] Filed: Mar. 20, 1995

[51] Int. Cl.[6] ..... B05D 3/12; B41F 23/04

[52] U.S. Cl. ..... 427/288; 427/365; 427/398.2; 101/487

[58] Field of Search ..... 427/288, 359, 427/361, 365, 398.2, 398.1; 101/487; 34/392, 397–399; 118/59, 69, 101

[56] References Cited

U.S. PATENT DOCUMENTS

| | | | |
|---|---|---|---|
| 3,442,211 | 5/1969 | Beacham | 101/416 |
| 3,676,910 | 7/1972 | Gross | 29/202 D |
| 3,886,683 | 6/1975 | Hudgin et al. | 47/9 |
| 4,369,584 | 1/1983 | Daane | 34/12 |
| 4,462,169 | 7/1984 | Daane | 34/62 |
| 4,476,636 | 10/1984 | Gross | 34/114 |
| 4,774,771 | 10/1988 | Littleton | 34/62 |
| 5,111,595 | 5/1992 | Bessinger et al. | 34/18 |
| 5,121,560 | 6/1992 | Daane et al. | 34/13 |
| 5,184,555 | 2/1993 | Quadracci et al. | 101/417 |

FOREIGN PATENT DOCUMENTS

| | | | |
|---|---|---|---|
| 2102344 | 2/1983 | United Kingdom | 101/488 |

*Primary Examiner*—Michael Lusignan
*Assistant Examiner*—Fred J. Parker
*Attorney, Agent, or Firm*—Nilles & Nilles, S.C.

[57] ABSTRACT

A nip roll presses a hot, rapidly moving, endless printed and dried paper web into intimate contact with the exterior surface of a first downstream chill roll so as to improve the cooling efficiency of the first downstream chill roll, permit the use of fewer chill rolls, and prevent condensate streaking. The nip roll is specially designed to press the web into intimate contact with the first downstream chill roll while avoiding damage to the web, nip roll, or chill roll, and while avoiding ink picking on the web surface contacted by the nip roll. The nip roll has an elastomeric outer peripheral surface and is internally cooled so as to maintain the outer peripheral surface at an equilibrium temperature below that at which ink softening and resultant picking could occur. By eliminating concerns of condensate streaking, the nip roll also permits dryer operation at relatively low temperatures, thereby substantially reducing operating costs.

19 Claims, 6 Drawing Sheets

APPARATUS AND METHOD FOR PREVENTING INK RESOFTENING ON A PRINTED WEB AS THE WEB TRAVELS OVER A CHILL ROLL

BACKGROUND OF THE INVENTION

1. Field of the Invention

The invention relates to an apparatus and method for cooling an endless paper web after it exits a dryer of an offset printing system and, more particularly, relates to an apparatus and method for preventing the ink on the web from resoftening as the web traverses the first downstream chill roll.

2. Discussion of the Related Art

In high speed offset printing processes, an endless paper web up to 72" wide is fed through an offset press at speeds up to 3000 feet per minute (34 mph), where it is printed on at least one and typically both sides with a thermoplastic ink. The printed web is then drawn through a dryer which dries the web by evaporating most of the solvents from the ink. It is important to note, however, that dryers are not intended to and do not evaporate all solvents from ink. Were this the case, the ink would become brittle and crack and fall off from the web, thus forming a nonusable product. Industry standard therefore is to evaporate only 75–95% (typically 80–90%) of the solvents from the ink, thereby improving the finished product.

In the industry standard process, the printed and dried web exits the dryer at a temperature of about 280° –325° F. and enters an insulated sheet metal housing or "smokehood" which traps solvent vapors which are emitted by the still-hot web. The hot web then travels alternately over and under a series of cooled chill rolls which cool the web to or near room temperature.

Referring now to FIG. 1, when a rapidly moving web W emerges from the dryer and smokehood and makes apparent contact with a first downstream chill roll C, a layer of air A is formed between the web W and the surface of the chill roll C, causing a web-to-chill roll surface clearance $H_o$ on the order of 0.001"–0.002". It is with this air layer A and associated clearance that the present invention is concerned, and the manner in which they are formed and the problems produced thereby will now be described.

A widely held misconception is that the air layer A is formed by a boundary layer of air following the moving web and/or rotating chill roll. While such boundary layers do exist, they form little or no part in the formation of the air layer A because the average speed of the air following the web or roll decreases rapidly with distance from the web and hence exhibits a sharply decreasing low pressure flow profile. The resulting boundary layer is easily eliminated. Indeed, it has been proven by calculations that, at web speeds of 2000 feet per minute, the boundary layer produced by the moving web W can be eliminated by increasing the tension T on the web by less than 3%. The boundary layer following the chill roll surface can be eliminated even more easily because it is much smaller than the boundary layer following the web surface due to the fact that it has a very short distance in which to form, i.e., only that portion of the chill roll which is not contacted by the moving web—typically less than 180°.

Others have theorized that the air layer A between the web W and the first downstream chill roll C is the result of centrifugal forces produced by the web W as it bends around the chill roll C. These forces were theorized to throw the web outwardly away from the chill roll surface. However, it has been mathematically proven that the centrifugal forces actually present in the typical chill roll stand are of the same magnitude of the boundary layer effect and can be accommodated just as easily as the boundary layer.

It has been discovered that the air layer A is actually formed by a hydrodynamic pumping action occurring as the web W approaches the chill roll C. Specifically, air following the converging surfaces of the web W and chill roll C is drawn into a wedge which rapidly decreases in thickness as the web W approaches the chill roll C. Drawing air into this area of rapidly decreasing cross section acts as a pump which compresses the air to form the very thin but relatively high pressure air layer A between the web W and the chill roll C. Unlike boundary layers which are at extremely low pressure and can be eliminated quite easily, this relatively high pressure air layer cannot be removed simply by increasing web tension a few percent. Indeed, web tension T could be increased to the web breaking point without sufficiently reducing the thickness of the air layer A. This problem is exacerbated by the fact that the pumping action produced by the converging web and chill roll surfaces increases with increased speeds, resulting in higher-pressure and thicker air layers at higher press speeds.

The presence of the air layer A between the web W and the chill roll C produces at least two problems. First, and probably most obvious, chill roll performance is degraded because the cool surface of the chill roll is not in intimate contact with the web, thus decreasing heat transfer efficiency. This decrease is rather dramatic because air is a relatively poor heat conductor. Accordingly, more and/or larger chill rolls are required for complete web cooling than would be required if the web W were always in intimate contact with the first downstream chill roll C.

A second and more insidious problem arising from the formation of an air layer A between the web W and the first downstream chill roll C is solvent condensation and resulting ink resoftening and "picking." As discussed above, the web W is still very hot as it approaches the chill roll C, and residual solvents continue to evaporate from the hot web surfaces as the rapidly moving web W makes apparent contact with the first chill roll C. The solvent vapors in the air layer A quickly condense and accumulate on the relatively cold outer peripheral surface of the chill roll C. The accumulated solvents are then reabsorbed by the surface S of the previously-dried web W, thus resoftening the ink. The resoftened ink is then offset or "picked" on the next downstream surface to be contacted by the surface S of the web, typically the third chill roll on the chill roll stand. The defects caused by this picking or offsetting are referred to as "condensate streaks."

Condensate streaking is exacerbated by the fact that it does not necessarily take place only on the first chill roll. As discussed above, the cooling efficiency of the first downstream chill roll C is decreased due to the insulating effect of the air layer A. This decreased efficiency may prevent the web from being cooled sufficiently on the first chill roll C to prevent further solvent condensation and the resulting condensate streaking on subsequent chill rolls.

The need thus has been established to eliminate the air layer formed between a web exiting a dryer and the first downstream chill roll over which the web travels, or to at least eliminate the condensate streaking resulting from this air layer. Many have recognized that the air layer could be eliminated by pressing the web into intimate contact with the chill roll. However, all previous efforts to this effect have proven unsuccessful.

For instance, U.S. Pat. No. 4,369,584 to Daane attempted to eliminate the problem of condensate accumulation by preventing the air layer between the web and the first downstream chill roll from ever forming by blowing high pressure air on the moving web from a nozzle or orifice. Intimate contact between the web and chill roll is never achieved with this device; the air gap is only reduced in thickness. The Daane '584 patent teaches that the nozzle outlet should be located within 0.5" of the line of tangency between the web and the chill roll to optimize jet utility. In actual practice, the orifice has to be installed several inches downstream of the tangent line so as to prevent the air from the orifice from causing the web to move or flutter as the web exits the smokehood. Except for relatively low press speeds (below 1500– 1700 fpm), the Daane device did not achieve its goal. At press speeds of 1800 fpm and above (in common use today), excessive power is required to minimize the thickness of the air layer.

The Daane '584 patent also discusses the use of a mechanical nip roll to eliminate the air layer, but only as it applies to films or other webs that can be contacted without damage. There is no discussion of contacting a hot moving printed web without damaging the web or overheating the nip roll.

Others have recognized that the only practical way to achieve true intimate contact between the web and first downstream chill roll is to mechanically press the web directly onto the chill roll. One such device, disclosed in U.S. Pat. No. 3,442,211 to Beacham, pressed the web into intimate contact with the chill roll using a "squeegee-roll . . . coated or covered . . . with a layer of ink-resistant material such as a silicone compound or a synthetic plastic such as polytetrafluorethylene." The device failed to perform as predicted because the "squeegee-roll" surface absorbed heat from the endless web and quickly overheated. The overheated surface remelted the ink on the web, causing the ink to adhere to the hot surface and damage the printed product. Beacham attempted to overcome this deficiency by locating his nip roll at the point where the web was partially cooled and was leaving the chill roll rather than at the point of first web contact. Thus, nip rolls such as those proposed by Beacham damaged the printed web even worse than condensate streaking with no nip roll.

U.S. Pat. No. 4,476,636 to Gross describes a device which is designed to eliminate as much air as possible between the web and the chill roll surface. Gross states that the purpose of his invention is to achieve an air layer reduction rather than elimination of the air layer. Gross's use of a rubber covered "squeeze" roller applied directly to the surface of the chill roll has little or no effect on the cause of web flotation over the chill roll surface.

U.S. Pat. No. 5,111,595 to Bessinger is yet another attempt to overcome the problem of condensate formation on the first downstream chill roll causing ink resoftening. Bessinger speaks of a pressure roller to squeeze the web against the roller (chill roll). He admits to the impossibility of its use in practice because ". . . the web surface that faces away from the roller (chill roll) to be contacted cannot tolerate engagement by a solid object." Bessinger specifically wants to avoid contact with the outward web surface of a printed web traveling over a chill roll.

U.S. Pat. No. 5,184,555 to Quadracci is another attempt to solve the problem of condensate streaking at the chill roll. The Quadracci device attempts to cure the problem without direct contact to the chill roll or web. This device does not work in actual practice because it does nothing to eliminate the formation of condensate in the annular air space between the web and chill roll surface. So long as the printed web remains above a temperature of about 200° F., solvent will continue to evaporate from the web and condense on the chill roll surface.

The Quadracci patent also describes the Baldwin chill roll wiper device in use today on many web offset press systems. This device helps alleviate the condensate problem, but does not eliminate it. The Baldwin device uses a porous, absorbent cloth material that makes contact with the first downstream chill roll surface in the area left between where the web leaves the chill roll and the point of first web contact with the chill roll. Examination has shown that this device removes a portion of the condensate, but not all of it.

Still another solution to the air layer problem was proposed in U.S. Pat. No. 5,121,560 to Daane (the Daane '560 patent), which sought acceptable ways to cool an elastomer-coated nip roll in order to overcome the problems produced by the Beacham process. The Daane '560 patent is assigned to the assignee of the present application, and the inventors of the present invention were familiar with Daane's efforts. Daane points out the problems encountered when attempting to use an all-metal pressure roll or nip roll to press a web into intimate contact with a chill roll. Daane also discusses the problems involved when attempting to use an elastomeric pressure roll and states "the index of contact temperature preservation for an elastomeric pressure roll is very low and not effective for cooling the opposite side of the web which it contacts. In operation the elastomeric surface immediately becomes hot and does not cool and set the ink. Instead the pressure roll will pick and smear the ink to destroy the readability of the print . . . Thus efficient cooling of the unset ink, especially on both sides of the web in high-speed printing, remains a significant unsolved problem."

Daane attempted to solve this problem by cooling the nip roll peripheral surface from the exterior. Accordingly, the Daane '560 patent proposed a technique of positioning a doctor roll adjacent the nip roll to provide a metered amount of coolant on the outer peripheral surface of the nip roll upstream from the web. A later commercial embodiment achieved the same effect using a doctor spray bar.

Two problems were associated with the externally cooled nip roll proposed by the Daane '560 patent. First, the coolant had to be applied to the undersurface of the web to prevent coolant from dripping onto the web and mining the product. This technique required that the web contact the first downstream chill roll from below. Unfortunately, as many as 99% of existing chill roll stands contact the first downstream chill roll from above and thus are incompatible with Daane's technique. Second, it has been discovered that moisture is inevitably transferred to the web by the damp nip roll and that this moisture quickly accumulates on downstream chill roll surfaces. The web absorbs the accumulated moisture to the point that it becomes saturated and unusable. The process proposed by the Daane '560 patent thus solved the second problem produced by the Beacham technique only to produce a third problem which can be solved only at such great expense as to make the device unmarketable.

OBJECTS AND SUMMARY OF THE INVENTION

It is therefore an object of the invention to provide a nip roll which forces a rapidly moving endless printed and dried paper web into intimate contact with a chill roll of an offset printing system, thereby avoiding condensate streaking, and which performs this function without damaging the web, damaging the nip roll, or resoftening the ink on the web.

Another object of the invention is to increase the cooling efficiency of the first downstream chill roll contacted by an endless web exiting a dryer.

In accordance with a first aspect of the invention, these objects are achieved by providing an internally cooled nip roll having a thin elastomer layer on its outer peripheral surface and capable of forcing the web into intimate contact with the chill roll. The nip roll preferably comprises a metal shell having a layer of the elastomeric material affixed to an outer peripheral surface thereof, the metal shell having axially opposed coolant inlets and outlets. Preferably, the layer is formed from EPDM elastomer and is less than 0.15 inches thick.

Still another object of the invention is to provide an offset printing system capable of drying a printed web at lower than standard temperatures and/or of chilling the printed and dried webs using fewer than standard chill rolls.

In accordance with another aspect of the invention, this object is achieved by providing a system which includes a plurality of printing units which apply ink to at least one side of the web, thereby forming a printed web, a dryer which heats and dries the web to form a dried web, a fluid-cooled chill roll having an outer peripheral surface over which the dried web travels to cool the dried web, and a nip roll having a fluid-cooled interior and an outer peripheral surface formed from an elastomeric material. The nip roll is at least selectively positionable in an operative position in which the peripheral surface is disposed closely adjacent the peripheral surface of the chill roll to press the dried web into intimate contact with the chill roll so as to completely prevent solvent condensate formation on the chill roll.

Yet another object of the invention is to provide a system for controlling the operation of an internally cooled nip roll of an offset printing system.

In accordance with another aspect of the invention, this object is achieved by providing an electronically controlled actuator extendible to drive the nip roll from an inoperative position in which the nip roll is located remote from a chill roll to an operative position in which the nip roll presses a printed and dried web into intimate contact with a chill roll. A circuit is provided which extends the actuator to drive the nip roll into the operative position only when (1) the coolant is below a designated operating temperature, and (2) a peripheral surface of the nip roll is below a designated operating temperature.

Still another object of the invention is to provide an improved offset printing process which eliminates condensate streaking and ink picking at the chill roll stand.

Yet another object of the invention is to provide a process having one or more of the characteristics detailed above and capable of drying printed webs at lower than standard temperatures and/or of cooling the dried webs using fewer than standard chill rolls.

In accordance with yet another aspect of the invention, these objects are achieved by providing a method comprising applying ink to at least one side of a moving endless web to form a printed web, then conveying the printed web through a dryer to form a dried web, then conveying the dried web over a cooled chill roll, thereby cooling the dried web, and pressing the dried web into intimate contact with the chill roll so as to completely prevent solvent condensate formation on the chill roll, the pressing step comprising pressing a nip roll into the web, and wherein the pressing step takes place without ink picking by the nip roll. A further step incudes cooling the nip roll without applying coolant to any external surfaces of the nip roll.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Figure 1:
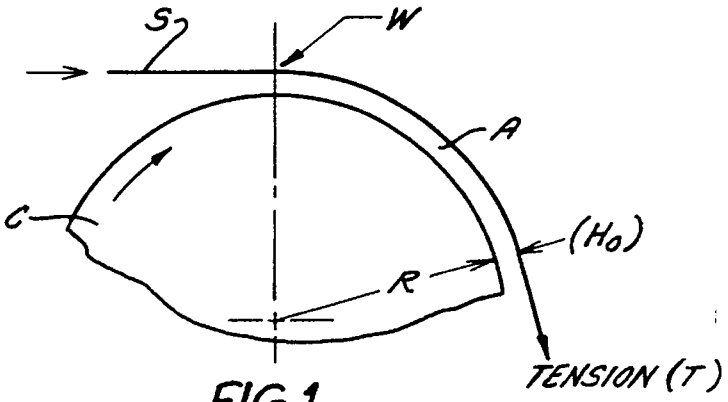
FIG. 1 PRIOR ART
FIG. 1 schematically represents the operation of a prior art chill roll, appropriately labeled "Prior Art"
Figure 2:
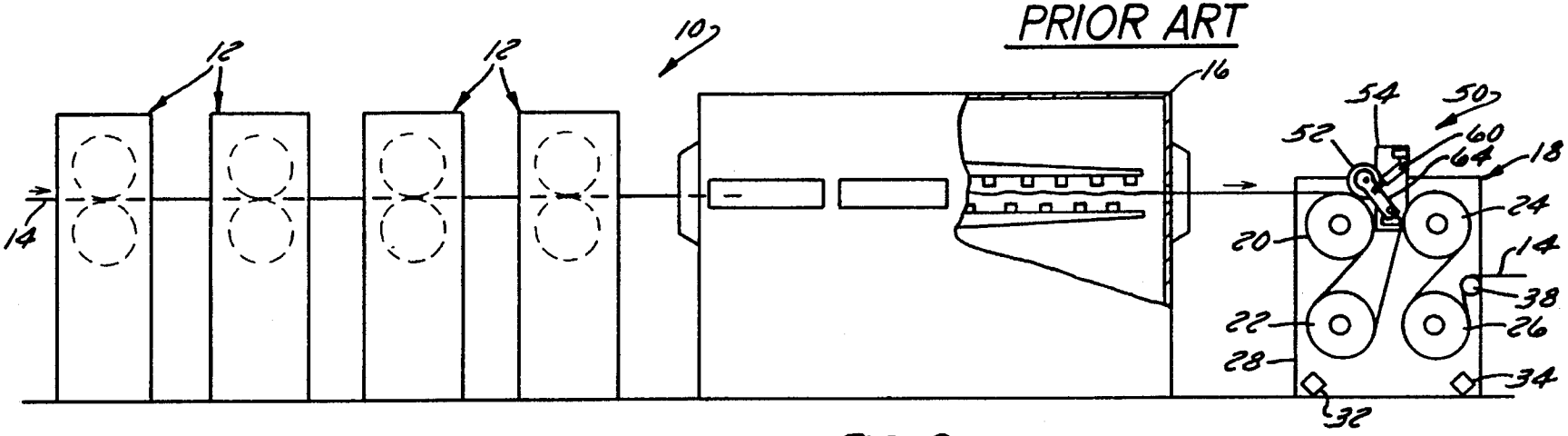
FIG. 2 schematically represents an offset printing system including a chill roll stand and nip roll constructed in accordance with a preferred embodiment of the present invention.
Figure 6:
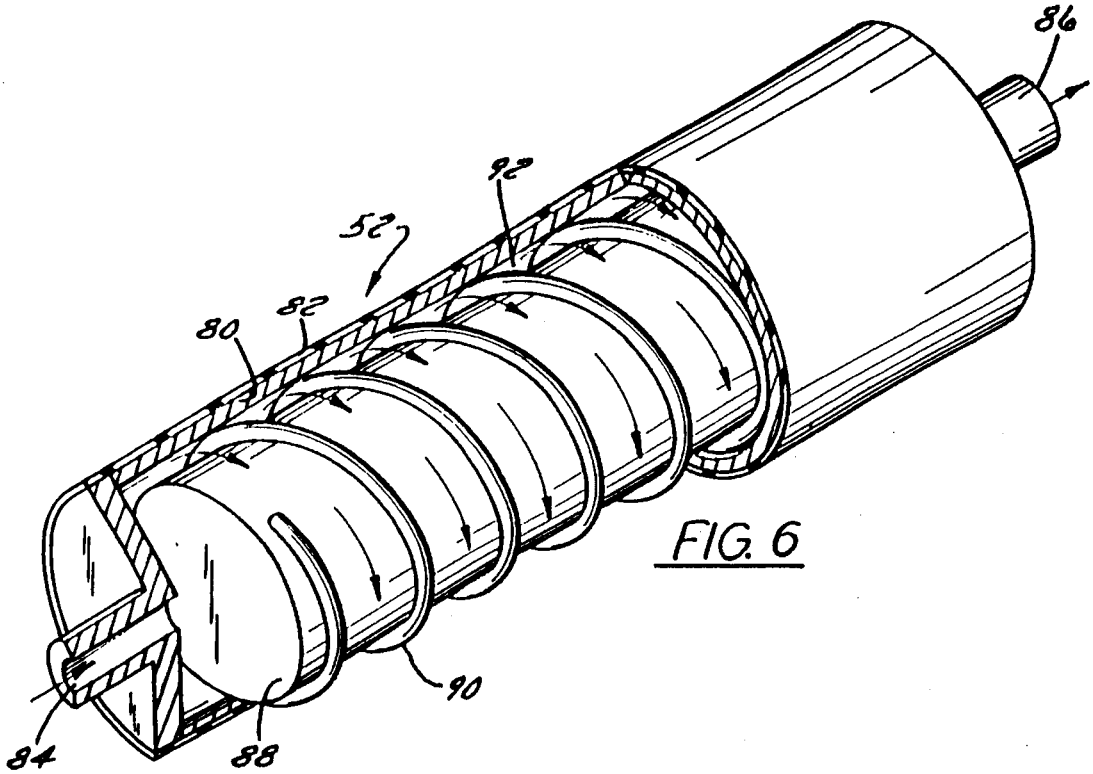
FIG. 6 is a partially cut-away perspective view of the nip roll of FIGS. 2–5.
Figure 3:
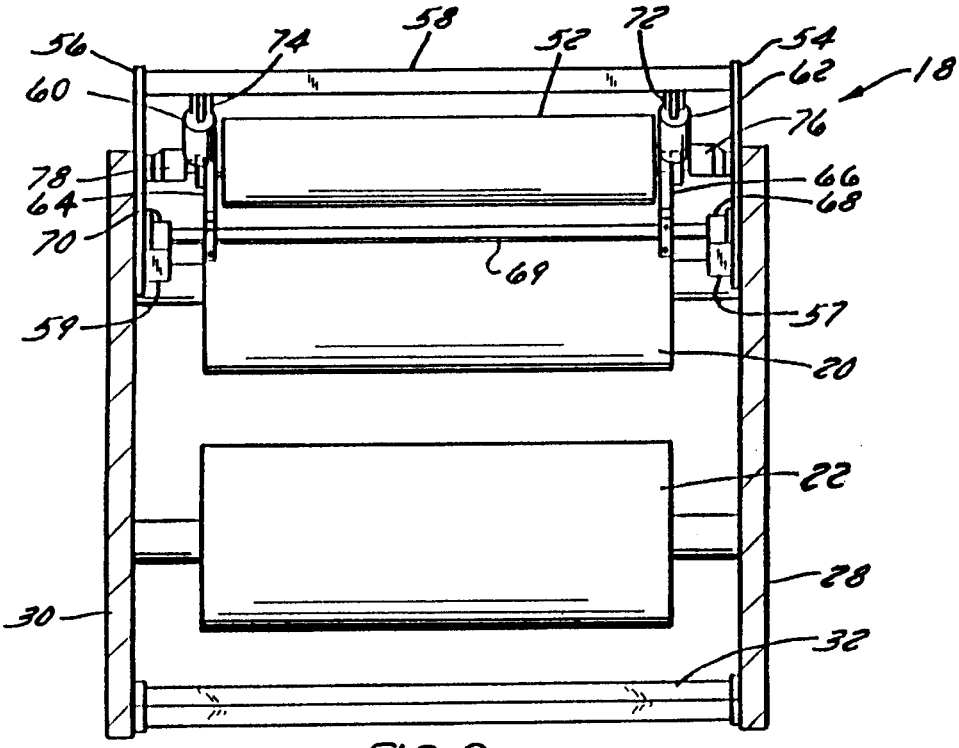
FIG. 3 is a sectional end view of the chill roll stand of FIG. 2.

Pursuant to the invention, an apparatus and method are provided for forcing a hot, rapidly moving, endless printed and dried paper web into intimate contact with the exterior surface of a first downstream chill roll so as to improve the cooling efficiency of the first downstream chill roll, permit the use of fewer chill rolls, and avoid condensate streaking. The apparatus takes the form of a nip roll specially designed to press the web into intimate contact with the first downstream chill roll while avoiding damage to the web, nip roll, or chill roll, and while avoiding ink picking by the web surface contacted by the nip roll. The nip roll has an elastomeric outer peripheral surface and is internally cooled so as to maintain the outer peripheral surface at an equilibrium temperature below that at which ink softening and resultant picking could occur. By eliminating concerns of condensate streaking, the nip roll also permits dryer operation at relatively low temperatures, thereby substantially reducing operating costs.

2. System Construction

Referring to FIGS. 2–6, an offset printing system 10 is provided which prints and dries an endless paper web 14 as it is conveyed through the system at speeds up to 2500 to 3000 feet per minute. The system 10 includes a plurality of ink units 12 each of which applies a basic color of ink to at least one and usually both sides of the web 14 as it is drawn through the system 10 by drive rolls (not shown). A flotation dryer 16 is located downstream from the ink units 12 for drying the printed web 14, and a chill roll stand 18 is located downstream from the dryer 16 for cooling the dried web. A nip roll assembly 50 is mounted on the chill roll stand 18 for pressing the web 14 into intimate contact with the first chill roll 20 contacted by the web 14 after it leaves the dryer 16 (called the "first downstream chill roll"). The ink units 12, flotation dryer 16, and associated but not illustrated devices, such as a smokehood, are conventional and will not be described in further detail.

The chill roll stand 18 typically comprises a plurality—four in the illustrated embodiment—of internally cooled metal chill rolls 20, 22, 24, 26 over and under which the web 14 passes after it leaves the dryer 16. The chill rolls 20, 22, 24, and 26 are coaxially and rotatably mounted on a support assembly formed from a pair of opposed vertical side plates 28, 30 connected to one another by suitable cross braces 32, 34. In the illustrated embodiment, the bottom surface of the web 14 is cooled by chill rolls 20 and 24 and the top surface is cooled by chill rolls 22 and 26. An idler roll 38 is also mounted on the chill roll stand 18 for guiding the dried and cooled web 14 through the chill roll stand 18 and out of the offset printing system 10.

The chill rolls 20, 22, 24, and 26 are, per se, well known. Each preferably takes the form of a hollow steel drum having internal channels 40 (FIG. 5) through which a coolant—typically water chilled to between 50° and 70° F.⊙—flows for cooling the web 14 as it travels over the outer peripheral surface of the roll.

The nip roll assembly 50 is designed to apply sufficient pressure (typically about 20–35 pounds per linear inch or pli) to the web 14 to press the web into intimate contact with the first downstream chill roll 20. The nip roll assembly 50 includes a nip roll 52, a support assembly, and an actuator assembly.

The support assembly may comprise any structure capable of supporting the nip roll 52 and actuator assembly on the chill roll stand 18. In the illustrated embodiment, the support assembly comprises a pair of opposed side plates 54, 56 connected to one another by an upper cross brace 58. The side plates 54, 56 are welded or otherwise fixed to the upper portions of the chill roll stand side plates 28, 30 at a location adjacent the first downstream chill roll 20. Stand outs 57 and 59 protrude inwardly from plates 54, 56 for supporting mounts 68 and 70.

Figure 4:
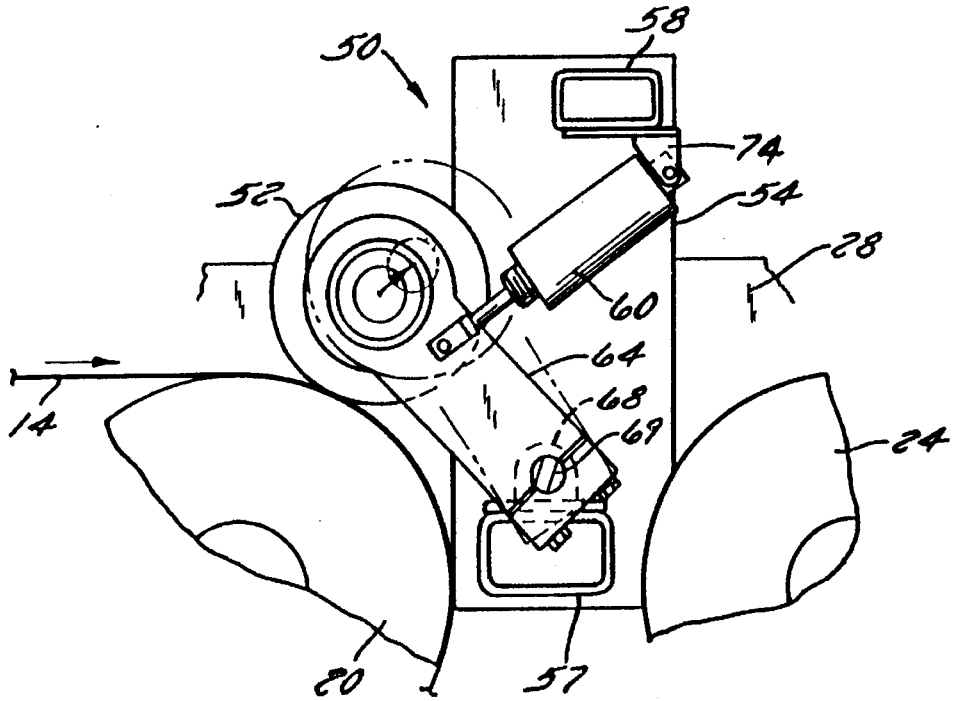
FIG. 4 is an enlarged fragmentary side elevation view of the nip roll of FIGS. 1 and 2 and of the cooperating portions of the chill roll stand.

The actuator assembly may comprise any structure capable of selectively moving the nip roll from its operative position illustrated in solid lines in FIG. 4 to its inoperative position illustrated in phantom lines in FIG. 4. In the illustrated embodiment, the actuator assembly comprises (1) a pair of actuators 60, 62 disposed proximate the opposed ends of the nip roll 52, and (2) a mating pair of pivot arms 64, 66. Each of the pivot arms 64, 66 rotatably receives a respective end of the nip roll 52 at a first end and is pivotally mounted at a second end to a pivot shaft 69 journaled on the mounts 68, 70. Each actuator 60, 62 preferably comprises a double-acting pneumatic cylinder pressurization of which is controlled by a pair of electronically controlled solenoids (seen only schematically in FIG. 8). Each of the cylinders 60, 62 has a cylinder portion pivotally connected to a bracket 72, 74 suspended from the upper cross brace 58 and a rod portion pivotally connected to a respective pivot arm 64, 66 at a location between the nip roll 52 and the bracket 68, 70. In a particularly sophisticated embodiment, the solenoid valves associated with each cylinder could be "feathered" or proportionally controlled to permit the pressure exerted by the nip roller to be varied on the fly and thus reduced as necessary to permit passage of a web splice or the like.

The nip roll 52 is rotatably mounted on the side plates 54, 56 via suitable bearing arrangements 76, 78 and is designed to press the web 14 into intimate contact with the chill roll 20 without damaging the web 14, nip roll 52, or chill roll 20 and without causing ink picking on the surfaces of downstream equipment. To this end, the nip roll 52 takes the form of a hollow metal (steel in the preferred embodiment) shell 80 covered with a layer 82 of elastomeric material bonded to the metal shell. Except for receiving the outer elastomer layer 82, the nip roll 52 is of standard construction and is commercially available, e.g., from F. R. Gross Company, Inc. of Stow, Ohio, and Webex, Inc. of Neehah, Wis. As is standard with rolls of this type, the shell 80 has an axial coolant inlet 84 and an opposed axial coolant outlet 86. A rod or barrel-like member 88 (FIG. 6) is disposed in the shell 80 and has a peripheral spiral ring 90 provided thereon which promotes spiral turbulent flow of coolant through a channel 92 in contact with the inner peripheral surface of the shell 80, thereby enhancing heat transfer through the shell 80 and elastomer layer 82.

The elastomer layer 82 must be employed to prevent damage to the web 14 and to the rolls 20 and 52 and to promote the application of uniform pressures along the width of the web 14. However all known elastomers are extremely poor heat conductors (or good insulators). It was heretofore thought that the insulating properties of such elastomer layers would prevent the use of an internally cooled nip roll. The inventors have found, however, that if the properties and dimensions of the elastomer layer 82 are carefully selected, and if the coolant properties and flow rates are carefully controlled, the elastomer layer 82 can be adequately cooled to reduce the steady state operating temperature of its outer peripheral surface to an acceptably low level. Considerations which must be addressed and solutions obtained include:

(1) Elastomer Property. The elastomeric material should exhibit relatively high thermal conductive properties, should be capable of being ground into a very thin layer while still being capable of being bonded to the steel shell, and must withstand temperatures in excess of 130° F. (the maximum desired temperature of the outer peripheral surface of the nip roll). The elastomer must also be sufficiently hard to assure intimate contact between the web and the chill roll along the entire length of the chill roll 20. EPDM (a terpolymer made from ethylene-propylene diene monomer) has been found to be the most suitable for these purposes and is the preferred material. However, other elastomeric materials exhibit satisfactory combinations of these characteristics and could also be used. Metallic powders or other heat conductive materials could also be mixed into the elastomer layer to increase heat transfer with the coolant in the nip roll.

(2) Elastomer Layer Thicknes. The elastomer layer should be as thin as possible so as to minimize the insulation effect of the layer and promote heat transfer therethrough. However, the layer must be thick enough so as not to peel off from the shell 80 in use. Layers of 0.10–0.15", and preferably 0.10", are considered suitable for these purposes. It is contemplated that these thicknesses will decrease with advances in elastomer technology.

(3) Nip Roll Diameter. The nip roll should be as large as practical to minimize the surface area percentage contacting and receiving heat from the web at any particular time. The nip roll must also be large enough to permit coolant to remain in the nip roll long enough to provide adequate heat transfer with the elastomer layer. The inventors have found that nip rolls of 8"–12" diameters meet these criteria, and a 10" diameter nip roll is preferred at this time. Less than 1% of the surface area of such a nip roll will contact a web at any given time. The remaining 99% accordingly is available for heat transfer from the elastomer cover to the coolant.

(4) Coolant Properties. Standard chill rolls employ water as their coolant or employ ethylene glycol solutions operating at temperatures typically in excess of 45° F. It has been discovered that such coolant temperatures do not provide adequate cooling of the nip roll. Ethylene glycol solutions can be cooled below the freezing point of water but exhibit lower heat transfer efficiency than water, and thus must be cooled still further and/or pumped through the nip roll at higher rates to provide adequate heat transfer. The flow rate of coolant through the nip roll also must be controlled so as to maintain the temperature change ($\Delta T$) within acceptably low limits.

It has been discovered that, assuming an elastomer having the properties discussed above is employed, sufficient heat transfer is achieved if a 30% ethylene glycol solution is used as the coolant, if the coolant enters the nip roll at a temperature of between 15–20° F., and if coolant flows through the nip roll at a rate of 10–12 gallons per minute. These parameters assume a press speed of 2500 feet per minute. If the press speed were to be increased to 3000 feet per minute, thus requiring more nip roll cooling, the fluid flow rate should increase to 14–15 per minute.

(5) Dryer Temperature. Although not a component of nip roll design per se, dryer temperature design is also an important consideration when designing the overall system. As discussed above, standard industry practice is to overheat the web to a temperature up to 320°–350° F. in an attempt to avoid condensate streaking. Such overheating not only overdries the ink and wastes energy, but also increases heat transfer to the nip roll from the web and exacerbates the nip cooling problem. Indeed, the temperature of the web 14 leaving the dryer 16 has more effect on the temperature of the nip roll 52 than any other external parameter because, other conditions being equal, the temperature on the outer peripheral surface of the nip roll would increase proportionally with the web temperature. Since the nip roll 52 completely eliminates condensate streaking, there is no need to overheat the web. It has been discovered that controlling the dryer 16 to heat web 14 to a temperature of 240°–260° F. adequately dries the web 14 and yet reduces heat transfer to the nip roll and reduces the need for nip roll cooling load.

In summary, assuming a web speed of 2500 feet per minute, the current preferred embodiment is to convey the web 14 out of the dryer 16 and to the first downstream chill roll 20 at a temperature of 240°–260° F. A 10" diameter nip roll 52 is pressed into contact with the web 14 under about 35 pli, thereby forcing the web 14 into intimate contact with the chill roll 20. The outer periphery of the nip roll 52 is formed from a 0.10" thick layer of EPDM. A coolant consisting of a 30% ethylene glycol solution is circulated through the nip roll at a temperature of 15°–20° F. and at a flow rate of 10–12 gallons per minute, thereby maintaining the temperature of the outer peripheral surface of the nip roll 52 below 130° F..

A coolant circuit 100 for controlling the flow of coolant through nip roll 52 will now be described.

3. Coolant Circuit

The coolant circuit 100 may comprise any system for forcing coolant through the nip roll 52 as described in Section 2 above. The preferred coolant circuit is closed loop and includes as its major components a conventional chiller evaporator 102, a coolant reservoir 104, and a pump 106 arranged in series. An inlet conduit leads from the pump 106 to the coolant inlet 84 of the nip roll 52, and an outlet conduit 110 leads from the coolant outlet 86 of the nip roll 52 to the chiller evaporator 102.

A flow valve 112 is disposed in the outlet conduit 110, and a bypass valve 114 is disposed in a branch line 116 connecting the inlet conduit 108 to the outlet conduit at a location downstream from the flow valve 112. The flow and bypass valves 112 and 114 are solenoid operated and controlled by the circuit 150 and logic 200 detailed in Section 4. The flow valve 112 is preferably normally open and the bypass valve 114 normally closed.

Many changes could be made to valves 112 and 114 without affecting the operation of the system 10. For instance, the flow valve 112 could be located in the inlet conduit 108 between the branch conduit 116 and the coolant inlet 84 of nip roll 52. The valves 112 and 114 could also be combined as a single three-way valve selectively causing coolant to flow through and bypass the nip roll 52.

Several safety and monitoring devices are also provided in coolant circuit 100. For instance, a safety bypass restrictor 118 and bypass line 120 are provided in parallel with branch conduit 116 for permitting limited coolant circulation through the chiller evaporator 102 if both valves 112 and 114 are closed or if flow adjustment valve 130 is closed, thereby preventing damage to the chiller evaporator 102. A standard low level switch 122 and flow switch 124 are also provided to shut down the system 100 and prevent damage to the chiller evaporator 102 in the event of a coolant leak. A temperature probe 126 is provided downstream of the chiller evaporator 102 for monitoring the temperature of coolant flowing to inlet conduit 108. In addition, in order to maintain coolant flow rates in the preferred range of 10–12 gallons per minute, a coolant flow meter is located in the inlet conduit 108 downstream from the conduits 116 and 120 to permit an operator to manually set a coolant flow adjustment valve 130 to maintain flow rates in the desired range.

4. Control Circuit

Figure 8:
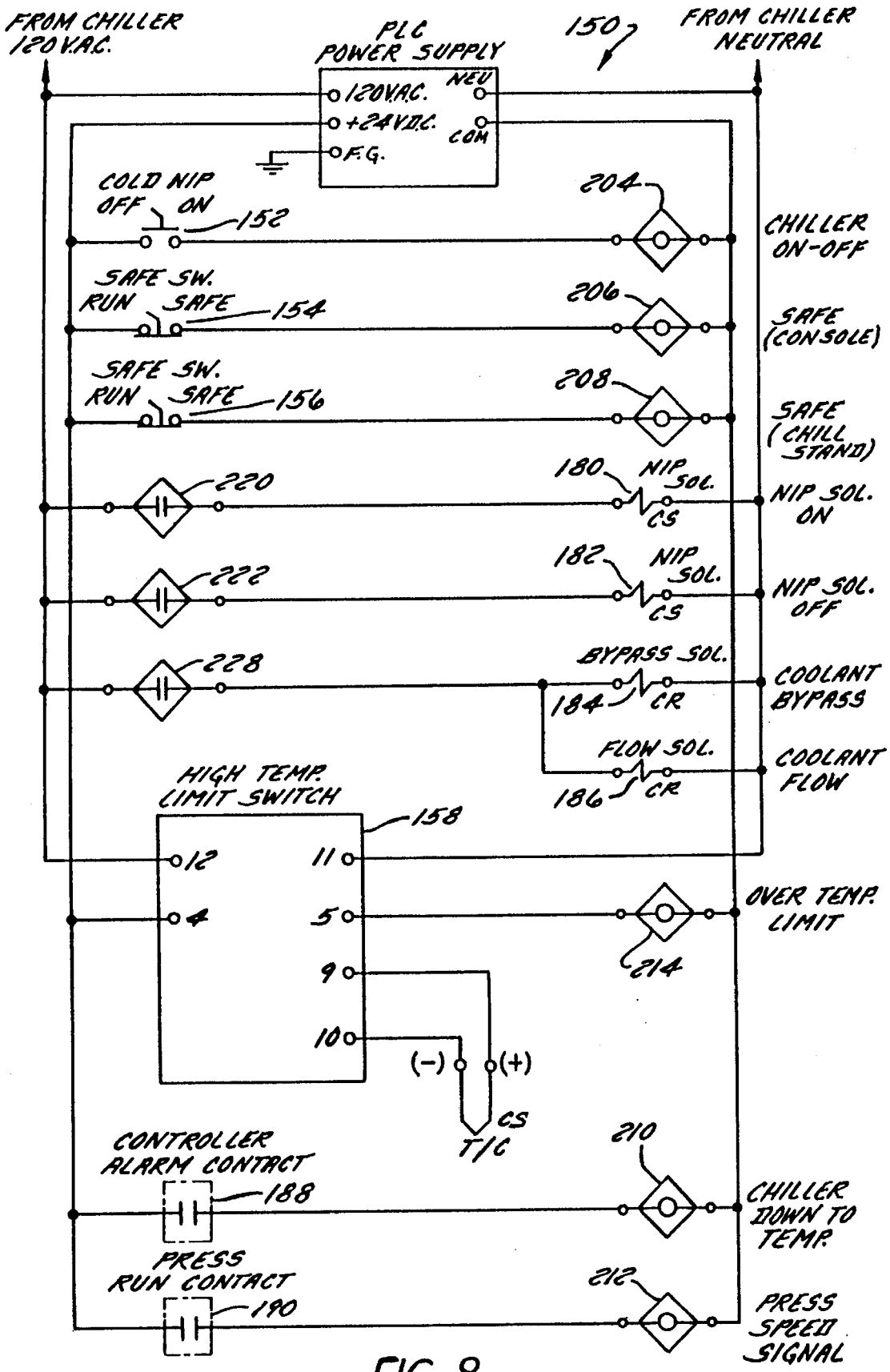
FIGS. 8 and 9 are schematic hardwired and PLC ladder diagrams, respectively, for controlling the operation of the nip roll and circuit of FIGS. 2–7.
Figure 9:
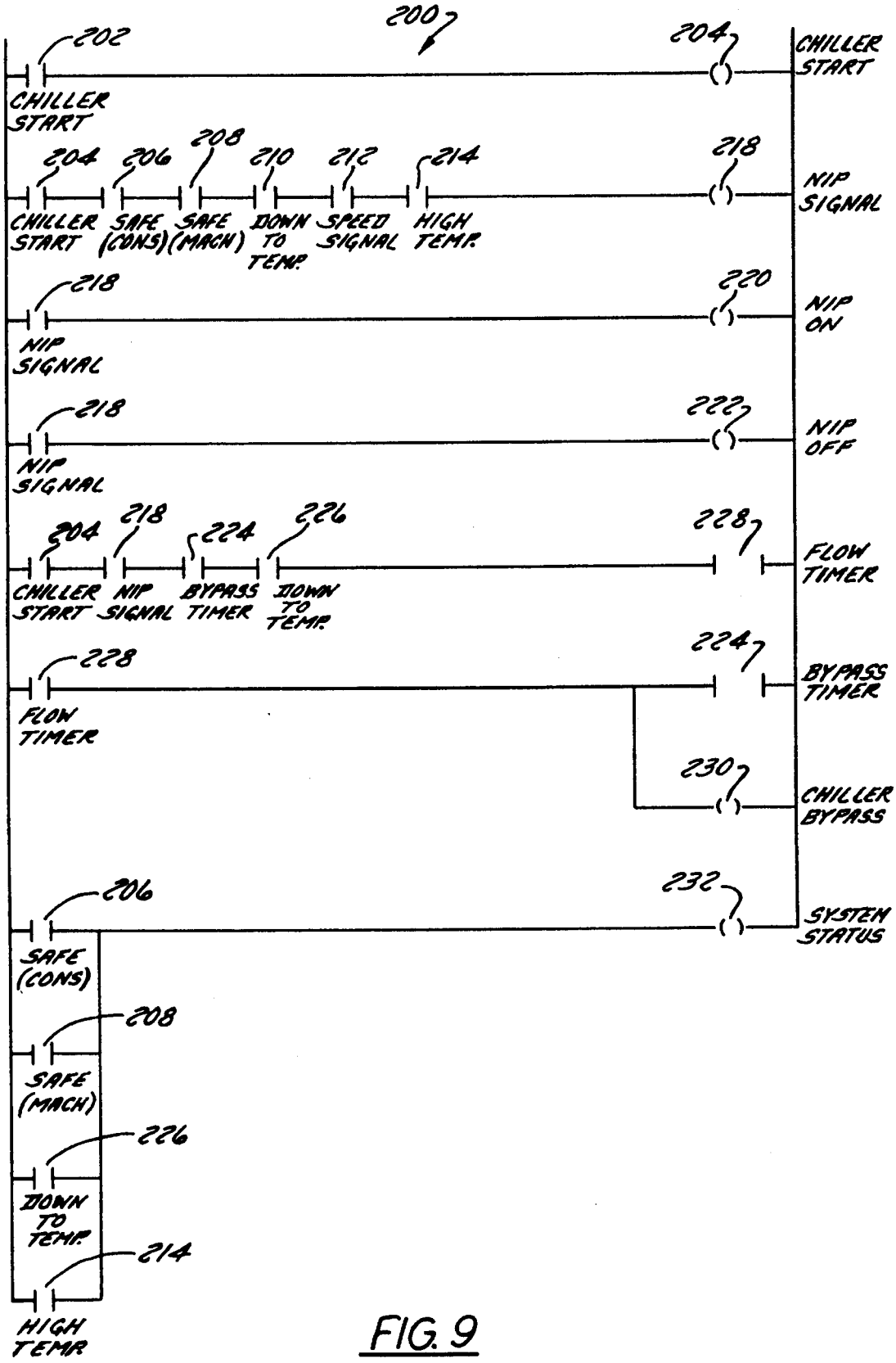

Referring now to FIGS. 8 and 9, a preferred hardwired system schematic 150 and PLC ladder diagram 200 are illustrated for controlling operation of the coolant circuit 100 and the nip actuators 60, 62. The construction and operation of devices constructed from these diagrams are believed to be self-explanatory from the drawings and will be discussed only briefly.

Figure 7:
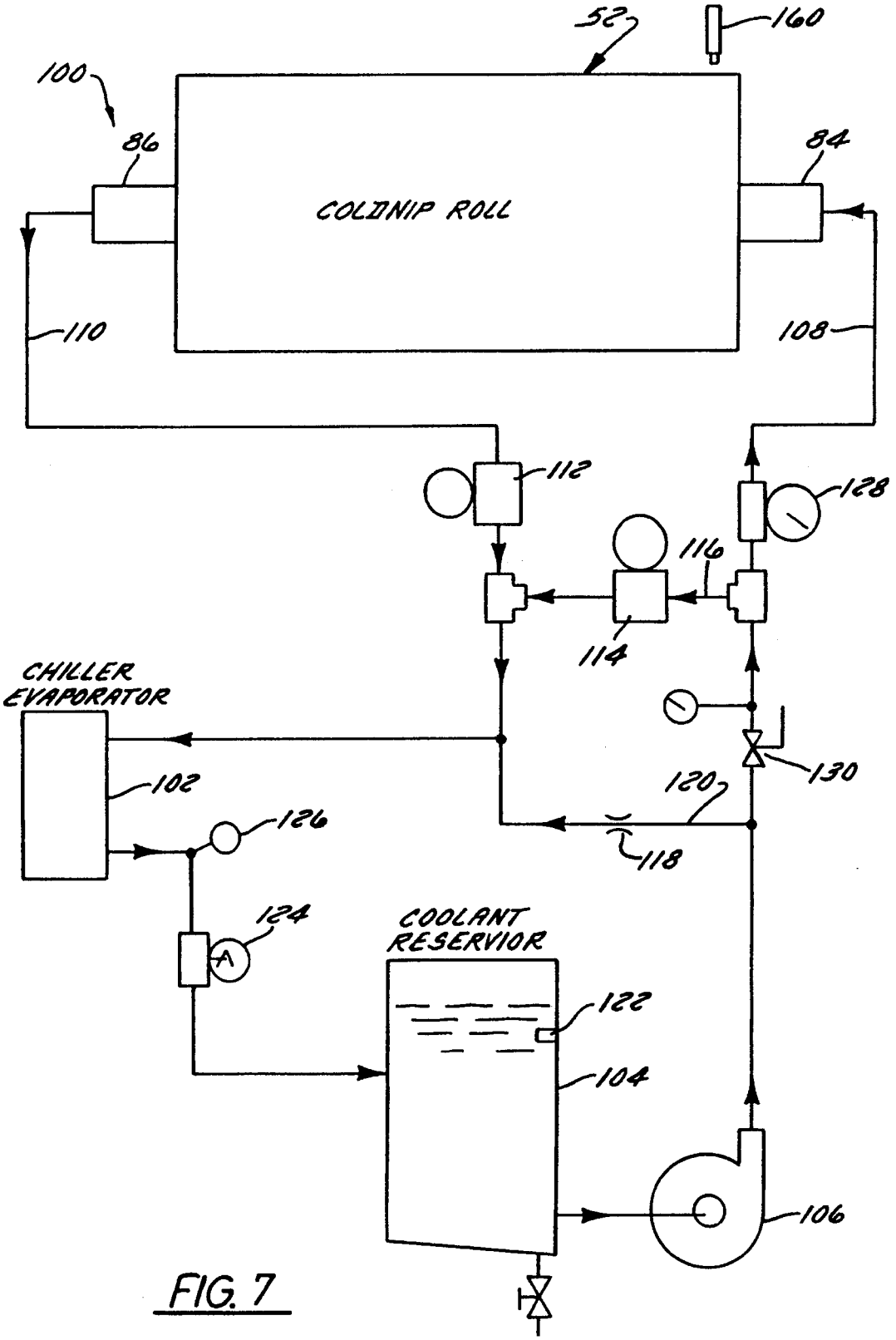
FIG. 7 schematically represents a preferred closed loop coolant circuit for cooling the nip roll of FIGS. 2–6.

The hardwired circuit 150 of FIG. 8 is preferably powered by the same source supplying power to the chiller evaporator 102. Inputs for the circuit 150 include a manually operated on/off switch 152, a first safety switch 154 located at the main console of the offset printing system 10, a second safety switch 156 located at the chill roll stand 18, and a high temperature limit switch 158. The safety switches 154, 156 are designed to prevent any operation of the nip roll 52 when personnel are in the vicinity of the chill roll stand 18. The high temperature limit switch 158 is responsive to an IR sensor 160 or the like (FIG. 7) monitoring the temperature of the outer peripheral surface of the nip roll 52. PLC input switches 204, 206 and 208 are closed upon closure of switches 152, 154, and 156. Similarly, a PLC switch 210 is activated if an alarm contact 188 is closed in response to the detection of an unacceptably high coolant temperature by probe 126, and a PLC switch 212 is activated by a conventional press run contact 190 monitoring press speed. PLC switches 220, 222 and 228 serve as outputs for the circuit 150 and actuate a first solenoid 180 controlling extension of the pneumatic cylinders 60 and 62, a second solenoid 182 controlling retraction of the pneumatic cylinders 60, 62, and solenoids 184, 186 for the bypass and flow valves 112 and 114, respectively.

Referring to FIG. 9, the PLC program usable in conjunction with the hardwired circuit of FIG. 8 is represented by a ladder diagram 200 the first rung of which includes a CHILLER START output signal 204 generated whenever the evaporator chiller 102 is active as detected by a logic switch 202. A NIP ON switch 218 is closed to generate a signal 220 energizing solenoid 180 in FIG. 8 and triggering extension of the actuating cylinders 60, 62 only if PLC switches 204, 206, 208, 210, 212, and 214 indicate that certain conditions are met. These conditions are: (1) the chiller evaporator 102 must be operational, (2) the safety switches 154 and 156 must not depressed, (3) coolant temperature as monitored by sensor 126 must be below an acceptable temperature of, for example, 20° F., (4) the press must be running at an acceptably high speed (as monitored by a press run contact 190 in FIG. 8), and (5) the temperature of the outer peripheral surface of the nip roll 52 as detected by the IR sensor 160 must be below a designated temperature of, for example, 150° F. If any one of these conditions are not met, the NIP OFF PLC signal 222 is generated at the next rung to cause the circuit 150 to energize solenoid 182 and retract the actuators 60, 62, thus placing the nip roll 52 in its inoperative condition.

The PLC ladder diagram 200 also illustrates the generation of a flow timer signal 228 in response to operation of switches 204, 218, 224, and 226. Generation of the flow timer signal 228 closes a corresponding switch which, for reasons detailed below, energizes the solenoids 184 and 186 in FIG. 8 to alternately and intermittently cycle the nip coolant circuit 100 between flow and bypass conditions (under the control of switches 224 and 228) when the nip roll 52 is in its inoperative position. Finally, a system status signal 232 may be generated in response to the operation of logic switches 206, 208, 210, and 214 to provide a visual and/or audible indication of the operational state of the system 100.

5. Operation

Figure 5:
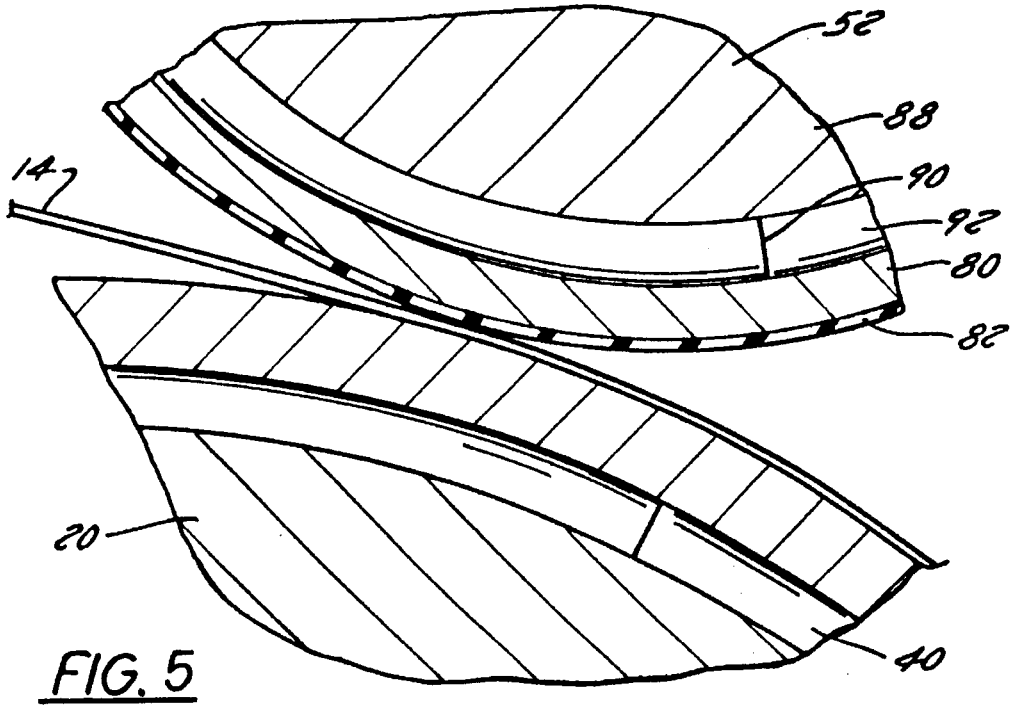
FIG. 5 is an enlarged fragmentary side sectional elevation view of the confronting portions of the chill roll and nip roll of FIGS. 2–4.

In operation, an endless paper web 14 is by coated by printing units 12, dried by dryer 16, and conveyed out of the dryer 16 and through the chill stand 18 at speeds up to 2000–3000 feet per minute as illustrated in FIG. 1. As the web 14 travels over the first downstream chill roll 20, it is pressed into intimate contact with the chill roll 20 by the nip roll 52, which preferably engages the web 14 near the point at which it first contacts the chill roll 20 as illustrated in FIG. 5. However, because the air layer between the web 14 and chill roll 20 is completely eliminated and intimate contact achieved, nip roll contact at this location is not essential, and the nip roll 52 could be located considerably downstream from this point if necessitated by system parameters. The intimate contact prevents condensate formation and the resulting condensate streaking, thus dramatically improving the product. Moreover, because an insulating air layer between the chill roll 20 and web 14 is absent, web cooling at the first chill roll 20 is dramatically enhanced, even if coolant is circulated through the chill roll 20 at a relatively high temperature of about 70° F. Indeed, it has been discovered that the web 14 is cooled up to 150° as it traverses chill roll 20, an increase of 55°–60° F. or more as compared to conventional processes in which intimate contact is not achieved.

The web 14 exiting the first downstream chill roll 20 is typically at a temperature of 100°–150° F. (assuming a dryer web exit temperature of 240°–280° F.) and exhibits no danger of ink softening or condensate streaking on subsequent chill rolls. Even if dryer 16 is operating at a higher web exit temperature range of 280° to 320° F., the web 14 will have a temperature of less than 200° F. as it leaves the chill roll 20, but solvent evaporation is reduced sufficiently to eliminate any condensate buildup on downstream chill rolls 22.24, 26. The paper wetting problems associated with externally cooled nip rolls of the type disclosed in Daane '560 patent are also eliminated because the nip roll 52 is cooled internally rather than externally.

The web continues to pass over and under successive chill rolls until it leaves the last roll at or near room temperature, i.e., 70°–90° F. Because of increased cooling at the first downstream chill roll 20, fewer chill rolls are required than are normally employed in the industry. As few as two or even one chill roll would be required in many instances.

So long as the actuators 60, 62 are extended to press the web 14 into intimate contact with the first downstream chill roll 20, the bypass and flow valves 114 and 112 will be closed and opened, respectively, to assure coolant flow through the nip roll 52 at a temperature of 15°–20° F. and at a flow rate of 10–12 gallons per minute (assuming a 30% ethylene glycol coolant solution and a press speed of 2500 feet per minute). Sufficient heat is transferred through the elastomer layer 82 to maintain the steady state operating temperature of the outer peripheral surface of the nip roll 52 below 130° F., and for the most part below 80°–120° F., thereby avoiding any ink softening by the nip roll 52 and ink picking on the downstream equipment.

If for any reason the circuit 150, 200 retracts the actuators 60, 62 to take the nip roll 52 off line, e.g., because a safety switch 154 or 156 is activated or because the coolant temperature as monitored by probe 126 is unacceptably high or the temperature of the outer peripheral surface of the nip roll 52 as monitored by sensor 160 is unacceptably high or the press run contact 190 is opened when the system 10 stops, the timing logic of the PLC 200 will control the valves 112, 114 to intermittently cause coolant to bypass and then flow through the nip roll 52. The purpose for this intermittent flow is two-fold. First, cooling of the outer peripheral surface of the nip roll 52 should be retained to permit restart upon short notice if the nip roll 52 is temporarily taken off line. Second, steady state coolant flow through the nip roll 52 must be terminated to prevent excess cooling and frost buildup on the outer surfaces of the nip roll 52. Intermittently circulating coolant through and bypassing the nip roll 52 for about 30 seconds to one minute intervals has been found to achieve these goals.

Many changes and modifications could be made to the present invention without departing from the spirit thereof. The scope of such changes will become apparent from the appended claims.

We claim:

1. A method comprising:

(A) applying ink to at least one side of a moving endless paper web to form a printed web; then (B) conveying said printed web through a dryer to form a dried web; then (C) conveying said dried web over a cooled chill roll, thereby cooling and reducing the temperature of said dried web;

(D) pressing said dried web into intimate contact with said chill roll so as to substantially completely prevent solvent condensate formation on said chill roll and to enhance web cooling taking place during said step (C), said pressing step comprising pressing an elastomer coated nip roll into said web without softening said ink, wherein heat is transferred to said nip roll from said web during said pressing step; and (E) cooling an outer peripheral surface of said nip roll without applying coolant to said outer peripheral surface.

2. A method as defined in claim 1, wherein said steps (B) and (C) comprise conveying said web at a speed above 2,500 feet per minute.

3. A method as defined in claim 1, wherein said steps (B) and (C) comprise conveying said web at a speed of about 3,000 feet per minute.

4. A method as defined in claim 1, wherein said web exits said dryer at a temperature below about 325° F.

5. A method as defined in claim 4, wherein said web exits said dryer at a temperature between about 240° F. and 280° F.

6. A method as defined in claim 4, wherein said web leaves said chill roll at a temperature between 100° F. and 150 ° F.

7. A method as defined in claim 1, wherein the step of cooling said outer peripheral surface of said nip roll comprises conveying a liquid coolant through said nip roll in contact with an inner peripheral surface thereof.

8. A method as defined in claim 7, wherein the step of cooling said outer peripheral surface of said nip roll comprises conveying an ethylene glycol solution through said nip roll at an initial temperature of between 15° F. and 20° F. and at a flow rate of 10 to 15 gallons per minute.

9. A method as defined in claim 7, wherein the step of cooling said outer peripheral surface of said nip roll comprises maintaining the temperature of said outer peripheral surface of said nip roll below 150° F.

10. A method as defined in claim 9, wherein the step of cooling said outer peripheral surface of said nip roll comprises maintaining the temperature of said outer peripheral surface of said nip roll between 80° F. and 120° F.

11. A method as defined in claim 7, further comprising retracting said nip roll from said chill roll to place said nip roll in an inoperative position, and further comprising intermittently preventing coolant flow through said nip roll when said nip roll is in said inoperative position.

12. A method as defined in claim 1, wherein said pressing step comprises applying 20–35 pounds per linear inch pressure to said web.

13. A method as defined in claim 12, wherein said pressing step comprises reducing said pressure when a web splice passes over said chill roll.

14. A method as defined in claim 1, wherein, during the step of pressing said nip roll into said web, less than 1% of said outer peripheral surface of said nip roll contacts said web at any one time.

15. A method as defined in claim 1, wherein said nip roll presses against said web adjacent a point where said web first contacts said chill roll.

16. A method as defined in claim 7, wherein the step of conveying said dried web over a cooled chill roll comprises conveying said web over a chill roll through which water is conveyed at an initial temperature of at least 50° F., and wherein the step of cooling said outer peripheral surface of said nip roll comprises conveying said liquid coolant through said nip roll at an initial temperature of less than 20° F.

17. A method comprising:

(A) applying ink to at least one side of a moving endless paper web to form a primed web; then (B) conveying said printed web through a dryer to form a dried web; then (C) conveying said dried web over an internally cooled chill roll, thereby cooling said dried web;

(D) pressing said dried web into intimate contact with said chill roll so as to substantially completely prevent solvent condensate formation on said chill roll and to enhance web cooling taking place during said step (C), said pressing step comprising pressing an elastomer coated nip roll into said web without softening said ink, wherein heat is transferred to said nip roll from said web during said pressing step, and wherein less than 1% of said outer peripheral surface of said nip roll contacts said web at any one time; and (E) cooling an outer peripheral surface of said nip roll by conveying a liquid coolant through said nip roll in contact with an inner peripheral surface of said nip roll.

18. A method comprising:

(A) applying ink to at least one side of a moving endless paper web to form a primed web; then (B) conveying said printed web through a dryer to form a dried web; then (C) conveying said dried web over an internally cooled chill roll, thereby cooling and reducing the temperature of said dried web;

(D) pressing said dried web into intimate contact with said chill roll adjacent a point where said web first contacts said chill roll so as to substantially completely prevent solvent condensate formation on said chill roll and to enhance web cooling taking place during said step (C), said pressing step comprising pressing an elastomer coated nip roll into said web without softening said ink, wherein heat is transferred to said nip roll from said web during said pressing step, and wherein less than 1% of said outer peripheral surface of said nip roll contacts said web at any one time; and (E) cooling an outer peripheral surface of said nip roll by conveying a liquid coolant through said nip roll in contact with an inner peripheral surface of said nip roll.

19. A method comprising:

(A) applying ink to at least one side of a moving endless paper web to form a printed web; then (B) conveying said printed web through a dryer at a speed of over 3000 feet per minute to form a dried web, said web having a temperature of between 240° F. and 280° F. when it exits said dryer; then (C) conveying said dried web over an internally cooled chill roll at said speed of over 3000 feet per minute, thereby reducing the temperature of said dried web to between 100° F. and 150 20 F., said chill roll being cooled by conveying water through said chill roll at an initial temperature of between 50° F. and 70° F.;

(D) pressing said dried web into intimate contact with said chill roll adjacent a point where said web first contacts said chill roll so as to substantially completely prevent solvent condensate formation on said chill roll and to enhance web cooling taking place during said step (C), said pressing step comprising pressing an elastomer coated nip roll into said web without softening said ink, wherein said nip roll applies 20–35 pounds per linear inch of pressure to said web, wherein heat is transferred to said nip roll from said web during said pressing step to heat said nip roll, and wherein less than 1% of said outer peripheral surface of said nip roll contacts said web at any one time; and (E) cooling an outer peripheral surface of said nip roll so as to maintain the temperature of said outer peripheral surface of said nip roll between 80° F. and 120° F., the step of cooling said outer peripheral surface of the nip roll comprising conveying an ethylene glycol solution through said nip roll in contact with an inner peripheral surface of said nip roll and at a flow rate of 10 to 15 gallons per minute, said ethylene glycol solution having a temperature of between 15° F. and 20° F. upon entering said nip roll.

* * * * *